US010238577B2

(12) United States Patent
Gjertsen et al.

(10) Patent No.: US 10,238,577 B2
(45) Date of Patent: Mar. 26, 2019

(54) ORAL DELIVERY DEVICE AND METHODS

(71) Applicant: Zeteo Biomedical LLC, Austin, TX (US)

(72) Inventors: Jeff Gjertsen, Cedar Park, TX (US); Timothy Sullivan, Austin, TX (US)

(73) Assignee: ZETEO BIOMEDICAL LLC, Austin, TX (US)

( * ) Notice: Subject to any disclaimer, the term of this patent is extended or adjusted under 35 U.S.C. 154(b) by 65 days.

(21) Appl. No.: 15/645,810

(22) Filed: Jul. 10, 2017

(65) Prior Publication Data

US 2018/0021221 A1 Jan. 25, 2018

Related U.S. Application Data

(60) Provisional application No. 62/366,264, filed on Jul. 25, 2016.

(51) Int. Cl.
*A61J 7/00* (2006.01)

(52) U.S. Cl.
CPC ..... *A61J 7/0053* (2013.01); *A61J 7/0007* (2013.01)

(58) Field of Classification Search
CPC ..... A61J 7/0053; A61J 7/0007; A61J 1/00; A61M 15/0036; A61M 15/0045; A61M 15/0028; A61M 5/30; A61M 5/2033; A61M 15/0048; A61M 15/0051; A61K 9/0075; A61K 9/0046; A61K 9/0021
USPC ..... 604/514
See application file for complete search history.

(56) References Cited

U.S. PATENT DOCUMENTS 3,518,992 A * 7/1970 Howell ..... A61M 15/0028 128/203.15
5,366,122 A * 11/1994 Guentert ..... A61M 13/00 128/200.22
5,522,383 A * 6/1996 Calvert ..... A61M 15/0028 128/203.15
7,806,117 B2 * 10/2010 Tsutsui ..... A61M 15/0028 128/200.24
8,695,592 B2 * 4/2014 Harrison ..... A61J 1/00 128/203.21
2008/0177246 A1 * 7/2008 Sullivan ..... A61M 11/06 604/520
2010/0083963 A1 * 4/2010 Wharton ..... A45F 5/00 128/203.15
2015/0274344 A1 * 10/2015 Sullivan ..... B65D 75/326 53/492

OTHER PUBLICATIONS

International Search Report and Written Opinion, dated Oct. 2, 2017, from corresponding PCT Application No. PCT/US2017/041397.

* cited by examiner

*Primary Examiner* — Manuel A Mendez

(57) ABSTRACT

Devices for delivery of fluid compositions include a delivery device including an internally pierced blister in which the device includes a plunger configured to crush the blister and deliver the contents in a lateral direction with respect to the motion of a dispensing button. Certain devices are configured for oral delivery.

24 Claims, 8 Drawing Sheets

ORAL DELIVERY DEVICE AND METHODS

CROSS REFERENCE TO RELATED APPLICATIONS

This application claims benefit of priority to U.S. Provisional Application No. 62/366,264, filed Jul. 25, 2016, which is incorporated herein in its entirety by reference.

BACKGROUND OF THE INVENTION

Sublingual and buccal delivery of active agents for absorption into the blood without exposure to the gastric environment is known for many types of drugs, biologics, botanicals, vitamins, minerals and other substances. Conventional delivery can utilize liquids, tablets, lozenges, sprays, or films, for example. A spray device for sublingual delivery is described in U.S. Pat. No. 8,734,392 ('392), for example, which describes devices that rely on a pump action in which a pump action causes a needle end to be inserted into a reservoir that is much larger than a single dose It is often difficult for this type of device to deliver a precise dosage amount, and to avoid wastage of liquid remaining in the reservoir after dosage. This can be a particular problem when the dosage ingredients include a controlled substance. The devices described in the '392 patent can also include a dependence on secondary packaging to maintain sterility of its contents during manufacture, shipping and storage. Sterile products, especially those packaged as individual premeasured portions, present significant packaging challenges, as many such products are susceptible to chemical or photo-degradation, chemical reaction and/or inactivation upon exposure to air, water, light, microbial contamination or other environmental factors.

BRIEF SUMMARY OF THE INVENTION

The present disclosure is directed to delivery devices for delivery of a fluid composition, in which the device includes a housing containing an internally pierced blister containing a fluid to be delivered and a piercing device comprising a delivery channel and outlet nozzle; a button device at least partially contained in the housing; and a plunger in contact with the button device and configured to crush the blister and deliver the fluid through the internal piercing device and outlet nozzle in a direction lateral to the direction of motion of the plunger.

In certain embodiments the fluid is a liquid, powder or a reconstituted powder and the device is configured to deliver the fluid to the sublingual or buccal mucosa or oral cavity of a user. In certain embodiments the fluid is a cardiovascular drug, steroid, barbiturate, benzodiazepine, analgesic, sedative, anesthetic, antigen, vaccine, hormone, cannabinoid, vitamin, biosimilar, alkaloid or opioid analgesic, with fentanyl being an exemplary analgesic.

The disclosure also includes methods of delivery of fluid compositions. A method of delivering a fluid substance to the sublingual tissue of a human or non-human using the disclosed devices.

It is contemplated that any embodiment discussed in this specification can be implemented with respect to any process, device, or composition of the invention, and vice versa. The term "about" as used herein is defined as being close to as understood by one of ordinary skill in the art, and in one non-limiting embodiment the terms are defined to be within 10%, within 5%, within 1%, or within 0.5%. The term "substantially" and its variations as used herein are defined as being largely but not necessarily wholly what is specified as understood by one of ordinary skill in the art, and in one non-limiting embodiment substantially refers to ranges within 10%, within 5%, within 1%, or within 0.5%. The use of the word "a" or "an" when used in conjunction with the term "comprising" in the claims and/or the specification may mean "one," but it is also consistent with the meaning of "one or more," "at least one," and "one or more than one."

It is to be understood that each of the variously stated ranges herein is intended to be continuous so as to include each numerical parameter between the stated minimum and maximum value of each range. It is to be further understood that, while not intending to limit the applicability of the doctrine of equivalents to the scope of the claims, each numerical parameter should at least be construed in a manner consistent with the reported number of significant digits for each numerical parameter and by applying ordinary rounding techniques. It is to be even further understood that, while not intending to limit the applicability of the doctrine of equivalents to the scope of the claims, even though a number may be contained within a numerical range wherein at least one of the minimum and maximum numbers of the range is preceded by the word "about," each numerical value contained within the range may or may not be preceded by the word "about." For Example, a range of about 1 to about 4 includes about 1, 1, about 2, 2, about 3, 3, about 4, and 4.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features and advantages of the present invention will become apparent from the following detailed description. It should be understood, however, that the detailed description and the examples, while indicating specific embodiments of the invention, are given by way of illustration only. Additionally, it is contemplated that changes and modifications within the spirit and scope of the invention will become apparent to those skilled in the art from this detailed description.

BRIEF DESCRIPTION OF THE SEVERAL VIEWS OF THE DRAWINGS

The following drawings form part of the present specification and are included to further demonstrate certain aspects and embodiments of the present invention. The disclosure may be better understood by reference to one or more of these drawings in combination with the detailed description of specific embodiments presented herein.

DETAILED DESCRIPTION OF THE INVENTION

Figure 1:
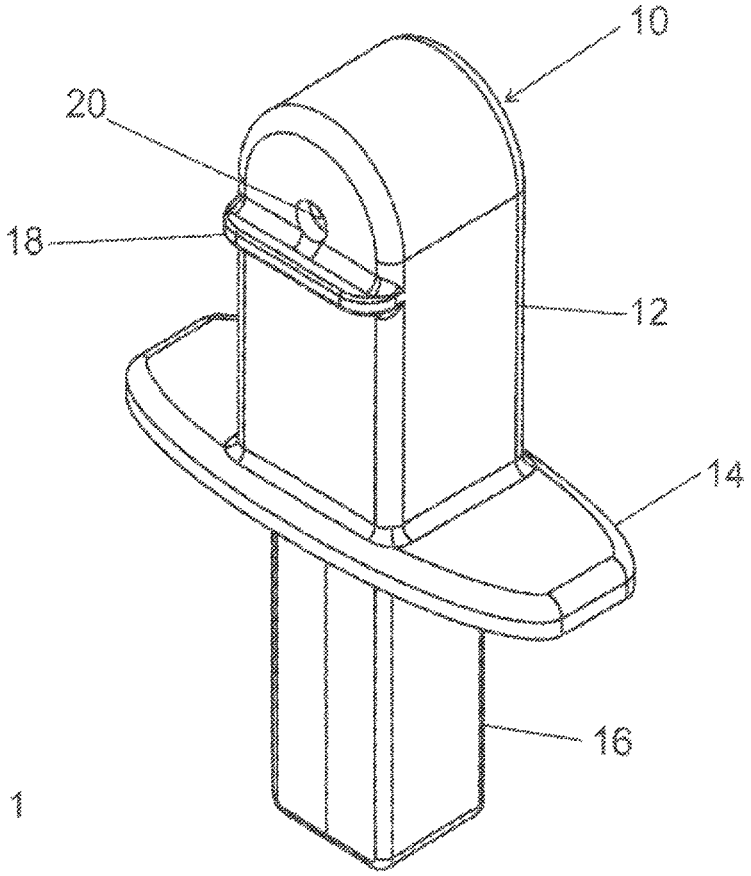
FIG. 1 is an illustration of a delivery device of the disclosure.

The present disclosure is directed to oral delivery devices for delivery of fluidic compositions to an oral cavity, or in certain embodiments to the sublingual or buccal mucosa of an oral cavity. The devices are adapted for delivery of liquids or powders into the mouth for pharmaceutical or non-pharmaceutical applications in both human and non-human animals including, but not limited to pets, agricultural or research animals for veterinary or human, nutritional, nutraceutical, diagnostic, immunological, anesthetic, or naturopathic compositions among other. While described herein in terms of oral delivery of compositions to the mouth, it is understood that the devices can be used for any number of other uses such as dyes, cosmetics, cosmeceuticals, ignitable materials, etc. that would occur to those of skill in the various arts. The devices can also be used for delivery to other mucosal or absorptive tissues, including, but not limited to optic, nasal, vaginal, rectal, axilla (armpit) or other appropriate tissues.

As used herein, the term sublingual is meant to convey its accepted meaning in the art, for example, "under the tongue" which refers to the pharmacological route of administration by which drugs diffuse into the blood through tissues under the tongue. As used herein, the term buccal is meant to convey its accepted meaning in the art, for example, "inside cheek" which refers to the pharmacological route of administration by which drugs diffuse into the blood through tissues inside cheek or between the inside cheek and gum. Many drugs are designed for sublingual or buccal administration, including cardiovascular drugs, steroids, barbiturates, benzodiazepines, analgesics, sedatives, antigens, vaccines, hormones, cannabinoids, biosimilars, alkaloid or opioid analgesics with poor gastrointestinal bioavailability, enzymes, vitamins and minerals. An exemplary sublingual drug for use in the disclosed devices includes opioid analgesic, including but not limited to fentanyl.

The disclosed devices may also be described in certain embodiments as devices for dispensing a predetermined quantity of fluid into the tissues as described above, in which a predetermined quantity of fluid is contained in, or produced in an ampule or blister that is crushed by a plunger with sufficient force to drive the blister against an internal piercing mechanism, piercing the blister and forcing the fluid contents from the blister and through a delivery channel into a spray, stream or droplets. A predetermined quantity refers, in most instances to a single dose of medication or a pharmaceutical, medical or other composition, and in certain embodiments to a prescribed dose. A predetermined quantity of fluid may also be a partial dose when delivery of a dose is administered in two or more spray events. Any agent that is deliverable in a powder, reconstituted powder or liquid form is contemplated in the present disclosure, including but not limited to antibiotics, antipyretics, anesthetics, anti-inflammatories, biologics, vitamins, co-factors, enzymes, inhibitors, activators, nutrients, aptamers, thioaptamers, vaccines including killed or live virus or microorganisms, nucleic acids, proteins, peptides, antibodies, peptide mimetics, or other agents known in the various arts. Medical compositions are in the form of a liquid, a powder, or a combination of liquid and powder and include one or more active agents and combinations of pharmaceutically acceptable carriers, solvents, diluents, preservatives, surfactants, salts, adjuvants, viscosity agents, buffers, chelators, or other ingredients known to those in the art as needed.

Although preferred embodiments of the devices are described herein primarily for use as oral delivery devices, it is understood that in certain embodiments the described devices can also be used for delivery to the eye, ear, mouth, nose, brain, lungs, or topical cutaneous areas of a user, by modification of the nozzle end of the devices. The devices can also be produced for veterinary use, for delivery of drugs to the nose, brain, eye or ear of an animal. For example, a device may include a nozzle for delivery into the ear canal of a user, or it may include a cup or nozzle for delivery to the eye of a user. The volume of a dose delivered for the various uses can also be adjusted as appropriate.

The volume and distribution of droplets or particles dispensed from the devices will depend on the site of dispensing as well as the content and viscosity of the composition to be delivered. In certain embodiments compositions to be delivered to the mouth would be from 1 μl to 1 ml, or from 1 μl to 5 ml, compositions to be delivered to the eye would be from 1 μl to 30 μl, or more typically from 7 μl to 30 μl. Dosages for nasal administration are typically from 75 μl to 500 μl and dosages for topical cutaneous administration can be larger, as much as 5000 μl or more. The volume, droplet distribution and size of droplets or particles released by a device can be adjusted to maximize the effective or therapeutic benefit of the dispersed substance. The volume of substance dispensed depends on the size of the compartment containing the substance, the unit dosage form blister, the piercer, the fill level, the degree to which the dosage form is compressed by the device and other variables in the construction of the devices, as well as characteristics of the substance dispersed, which are well understood by those skilled in the art. These variables can be appropriately dimensioned to achieve dispersal of a desired volume or droplet size of fluid or particle size of substance to the user. One of skill in the art understands that residual liquid or other substance after dispersal is taken into account when formulating the appropriate parameters for dispersing the desired dosage volume.

An advantage of the devices and unit blister designs set forth herein is that the sterility of the administered substance is maintained until the moment of use. Maintaining sterility until the moment of use minimizes or eliminates the need to use preservatives or bacteriostatic compounds in the substances administered, without risking contamination. In addition, if the blister is damaged, or is otherwise defective, the devices do not administer the substance, which may no longer be sterile. For example, if a blister is defective in the area of the pierceable section, or develops a leak, the devices will not dispense the substance properly because sufficient pressure will not be generated in the blister to effectively release the substance.

The devices typically include a body including a nozzle port for targeting the delivery site of a user, a trigger device to be operated by a user, a blister, containing a composition to be delivered and including a piercable membrane, a cavity within the body or nozzle containing the blister, a plunger or piston body, an actuator mechanism linking the trigger device to the plunger, a piercing mechanism positioned to pierce the dosage form upon activation of the trigger, and a discharge channel to release a spray of the fluid composition through the nozzle in a predetermined spray plume geometry and direction.

The blisters or dosage forms of the disclosure are described, in certain embodiments as including a dispensing blister chamber that contain a piercing device, wherein the piercing device is a substantially hollow, elongate member with a base end and a piercing tip opposite the base end and providing a discharge nozzle. In certain embodiments the dispensing blister conforms to at least the base end of the piercing device effective to support and hold the piercing device in place during manufacture and use of the dosage form. The piercing devices include one or more inlet openings on or near the base end and an internal conduit providing fluid communication between the one or more inlet ports and the discharge nozzle. The surface of the internal conduit can include structural features such as contours, steps, flutes, ribs, constrictions, channels or a combination thereof to control the spray pattern and droplet size of a fluid forced through the piercing device. It is a further aspect of the disclosure that the inlet openings provide a fluid path from the interior of the dispensing blister chamber into the internal conduit that comprises one or more bends, and that the combination of angular turns and the structural features of the internal conduit can create vortices or non-laminar flow in the fluid as it is forced through the piercing mechanism.

The structural features can be designed, for example, for different types of spiral, vertical and other flow and the design can be adjusted for different viscosities of the fluid or solid to be dispensed. For example, structural features may be added to create a vortex, to further mix the contents of the blister, to change the fluid property type from laminar to turbulent or vice versa or to change the dispense properties such as pressure, velocity, dispense duration, droplet size, droplet distribution and geometry and to accommodate varying properties of the drug compound such as density, surface tension or viscosity. Additionally, the inlets into the internal conduit can include bends of angles from about 0° to 90°, or more combinations in order to create the desired spray plume geometry for a particular medicament or fluid composition.

In certain embodiments, a shaped blister dosage form as described herein that contains medication and an internal piercing nozzle, is configured for use in a smaller diameter dispensing mechanism, while still providing an accurate dose of medicine in the form of a controlled spray. A blister strip including a plurality of such dosage forms can include a blister material layer in which the dosage forms are formed, and a lid material bonded to the blister material. A concentric sealing area provides a resilient seal that is not broken when the dosage forms are crushed to deliver the contained medication.

To produce a controlled spray of liquid when bursting a sealed formed recess, such as a shaped blister, an internal piercer inside the sealed blister may be used, and may be positioned such that it maintains contact with, or is positioned near the lid material. Internal piercers are disclosed in U.S. Ser. No. 11/114,251, U.S. Prov. No. 60/853,328 and 60/944,379, each of which is incorporated herein by reference. The internal piercer can take different shapes, including but not limited to a funnel design, or a disc shaped design. The internal piercer can constructed of any suitable materials including but not limited to ceramic, glass, metal, styrene, polystyrene, polymers, including but not limited to PET, polypropylene, polyethylene, polyphenylene, polyethermide or PEEK, and other pharmaceutical grade FDA approved materials of sufficient hardness to penetrate the lid material. The second, Forming Pin(s) may be designed to shape the formed recess such that the internal piercer is locked into place within the formed recess comprising the blister, e.g., through manufacture, handling, transportation, storage, and actual use. For example, in a shaped blister, a protruding structure, an indentation, a diaphragm or an annulus is formed to conform to the shape of the base of the internal piercer. The protruding structure, indentation, diaphragm, or annulus provides support for and holds the internal piercer in place during assembly and during dispensing. Thus, these structures functions to capture the internal piercer (e.g., restrict vertical movement of the piercer), thereby holding it in place. The internal piercer may also be held in place through manufacture and actual use by, for example, press fit, welding, hydrostatic forces, or electrostatic forces.

In preferred embodiments, the internal piercer includes a hollow tube or channel (the delivery channel) through which the fluid flows as the shaped recess is compressed and pierced. The tip of the piercer preferably has an angled or oval edge to aid in penetration of the lid material. The inside diameter of the piercer tube can range from about 0.015 inches to about 0.05 inches, but in certain preferred embodiments is about 0.025 inches or larger as required. The internal diameter, shape, or surface texture of the delivery channel, whether in, near, and/or at the exit point, may contain a nozzle or may be varied to form the optimum droplet size and spray plume geometry of the fluid as it exits the shaped article, as well as control the velocity, pressure, pattern, distribution, and aim of the released substance. Thus, the nozzle system and the piercer may be integrated into a single unit. The nozzle system can also be designed to determine the mixing of the substance as it is released.

To successfully dispense the fluid, the fluid must flow through the piercing nozzle with enough velocity to create the desired spray geometry and distance. As described herein, this is accomplished by pressing on the blister form with sufficient force to push the piercing nozzle through the lid material, completely crushing the blister and forcing the contents through the nozzle with the required velocity. During this dispensing operation, the seal of the lid material to the blister material must be strong enough that no leakage occurs prior to the nozzle piercing the lid.

In certain embodiments the blister is manufactured by processes for manufacturing shaped articles such as shaped structures, containers, packaging, or blisters, suitable for unit-dose packaging. The processes disclosed herein are capable of creating shapes and degrees of stretch in the film material that cannot be obtained by conventional methods known in the art. The processes of this disclosure involve clamping a film such as a foil laminate and forcing a succession of stamping tools (i.e., Forming Pins) into the film to produce a desired shaped recess or chamber (i.e., depression) in film. The process for manufacturing the shaped articles generally involves at least one retaining tool, at least one die, and at least two Forming Pins. The retaining tool and the die are designed to hold a film between them, with the die having at least one opening, which allows the film layer to be deformed into the desired shape of the formed recess.

Forming Pins of various shape, size, number and surface finish (which exert, for example, varying degrees friction on the film) may be incorporated into the process. For example, a forming process may use a first Forming Pin which exhibits a high degree of friction and a second or subsequent Forming Pins which exhibit progressively higher or lower degrees of friction. The film layer may include a variety of different materials, including, but not limited to, thermoplastics, polymers, copolymers, composites and laminates. When the unit dose is a pharmaceutical dosage form or a nutritional product, the film will need to be able to undergo manufacturing processes to produce sterile shaped articles, for example using aseptic production or gamma ray irradiation for terminal sterilization. Preferably the film is flexible but capable of holding its shape, creates a barrier, and has desirable chemical properties (e.g., does not react with the contents). For blister packs, the film is preferably a foil laminate, and more preferably a metal-plastic laminate. The metal-plastic laminate comprises a metal foil coated on at least one side, or on both sides, with one or more plastic polymer layer. If the metal-plastic laminate comprises a plastic polymer layer on both sides of the metal foil, the plastic polymer layers may be the same type of plastic polymer layer, or different types of plastic polymer layers.

Materials which may be used in the plastic polymer layer of the laminate are well known by those skilled in the art and include, but are not limited to, a variety of commercially available polymers and copolymers, such as polyvinylchloride, nylon, nylon derivatives, polybutylene terephthalate, polyethylene terephthalate, polyethylene, polypropylene, polystyrene, polyacetal, vinylidene chloride, propylene ethylene copolymers, polyethylene napthalate, fluoropolymers, cyclic polyolefins, polyamides, and similar materials or combinations thereof. The plastic layer may be present in the laminate at a thickness of about 8 μm to about 80 μm, about 10 μm to about 70 μm, about 15 μm to about 60 μm, about 20 μm to about 50 μm, or about 25 pan to about 40 μm, and any ranges therein. The plastic components may be non-stretched, or alternatively uniaxially or biaxially stretched, or may be thermoplastics such as halogen-containing polymers, polyolefins, polyamides, polyesters, acrylnitrile copolymers, or polyvinylchlorides. Typical examples of thermoplastics of the polyolefin type are polyethylenes such as low density polyethylene (LDPE), medium density polyethylene (MDPE), high density polyethylene (HDPE), uniaxially, or biaxially stretched polypropylenes, polypropylenes such as cast polypropylene and uniaxially or biaxially stretched polyethylene terephthalate (PET) from the polyester series. The above examples are in no way meant to be limiting, as other materials known in the art may be used in the plastic layer as well.

Examples of plastics based on halogen-containing polymers include but are not limited to polymers of vinylchloride (PVC) and vinyl plastics, containing vinylchloride units in their structure, such as copolymers of vinylchloride and vinylesters of aliphatic acids, copolymers of vinylchloride and esters of acrylic or methacrylic acids or acrylnitrile, copolymers of diene compounds and unsaturated dicarboxyl acids or their anhydrides, copolymers of vinylchloride and vinylchloride with unsaturated aldehydes, ketones, etc., or polymers and copolymers of vinylidenchloride with vinylchloride or other polymerizable compounds. The vinyl-based thermoplastics may also be made soft or pliable in a conventional manner by means of primary or secondary softeners.

If the plastic films comprise polyesters (PET-films), examples of polyesters include but are not limited to polyalkylene-terephthalate or polyalkylene-isophthalate with alkylene groups or radicals with 2 to 10 carbon atoms or alkylene groups with 2 to 10 carbon atoms interrupted by at least one oxygen atom, such as, e.g., polyethylene-terephthalate, polypropylene-terephthalate, polybutylene-terephthalate (polytetramethylene-terephthalate), polydecamethylene-terephthalate, poly 1.4-cyclohexyldimethylol-terephthalate or polyethylene-2.6-naphthalene-dicarboxylate or mixed polymers of polyalkylene-terephthalate and polyalkylene-isophthalate, where the fraction of isophthalate amount, e.g., to 1 to 10 mol. %, mixed polymers and terpolymers, also block polymers and grafted modifications of the above mentioned materials. Other useful polyesters are known in the field by the abbreviation PEN. Other polyesters are copolymers of terephthalic acid, a polycarboxyl acid with at least one glycol, copolymers of terephthalic acid, ethyleneglycol and an additional glycol, polyalkylene-terephthalates with alkylene groups or radicals with 2 to 10 carbon atoms, polyalkylene-terephthalates with alkylene groups or radicals with 2 to 10 carbon atoms which are interrupted by one or two oxygen atoms, polyalkylene-terephthalates with alkylene groups or radicals with 2 to 4 carbon atoms, and polyethyleneterephthalates (e.g., A-PET, PETP, PETG, G-PET). Glycol-modified polyesters are also referred to as PETG.

Examples of polyolefins for plastic films include but are not limited to polyethylenes (PE), e.g., high density polyethylene (HDPE, density larger than 0.944 g/cm), medium density polyethylene (MDPE, density 0.926-0.940 g/cm), linear polyethylene of medium density (LMDPE, density 0.926.0.940 g/cm), low density polyethylene (LDPE, density 0.910-0.925 g/cm), and linear low density polyethylene (LLDPE, density 0.916-0.925 g/cm), for example as non oriented (PE film) or uniaxially or biaxially oriented films (oPE film), polypropylenes (PP), such as axially or biaxially oriented polypropylene (oPP film), or cast polypropylene (cPP film), amorphous or crystalline polypropylene or mixtures thereof, ataktic or isotaktic polypropylene or mixtures thereof, poly-1-butene, poly-3-methylbutene, poly-4-methylpententene and copolymers thereof, polyethylene with vinylacetate, vinylalcohol, acrylic acid, such as, e.g., ionomeric resins, such as copolymers of ethylene with 11% acrylic acid, methacrylic acid, acrylic esters, tetrafluorethylene or polypropylene, statistical copolymers, block polymers or olefin polymer-elastomer mixtures, ionomers, and ethylene-acrylic acid copolymers (EAA).

When the plastic films comprise polyamide films (PA), examples of polyamides include but are not limited to polyamide 6, a homo-polymer of [ε]-caprolactam (polycaprolactam); polyamide 11, polyamide 12, a homo-polymer of [ω]-laurinlactam (polylaurinlactam); polyamide 6.6, a homo-polycondensate of hexamethylenediamine and adipinic acid (polyhexa-methylene-adi-amide); polyamide 6.10, a homo-polycondensate of hexa-methylene-diamine and sebacinic acid (poly-hexa-methylene-sebacamide); polyamide 6.12, a homo-polycondensate of hexa-methylene-diamine and dodecandic acid (poly-hexa-methylene-dodecanamide) or polyamide 6-3-T, a homo-polycondensate of trimethyl-hexa-methylene-diamine and terephthalic acid (poly-trimethyl-hexa-methylene-terephthalic-amide), and mixtures thereof.

When the plastic comprises acrylnitrile-copolymers, examples of acrylnitrile-copolymers include but are not limited to copolymers of acrylnitrile or methacrylnitrile with acrylic acid esters, vinyl-carboxylate esters, vinyl halides, aromatic vinyl compounds or unsaturated carboxylic acid and diene, and acrylnitrile-methylacrylate copolymers.

Metals which may be useful in the foil component of the laminate are those that can be formed into a foil with the physical and chemical properties (e.g., thickness, malleability, temperature resistance and chemical compatibility) sufficient to adhere to the plastic layer(s) and remain intact during the forming processes disclosed herein. Such metals include, but are not limited to, aluminum, iron, nickel, tin, bronze, brass, gold, silver, chrome, zinc, titanium, and copper, combinations thereof, as well as alloys including the aforementioned metals, such as steel and stainless steel. The metal foil may be present in the laminate, for example, at a thickness of about 8 μm to about 200 μm, about 10 μm to about 150 μm, about 15 μm to about 125 μm, about 20 μm to about 100 μm, or about 25 μm to about 80 μm, and any ranges therein. In certain embodiments the foils, e.g., aluminum foil, may have a purity of at least about 98.0%, more preferably at least about 98.3%, still more preferably at least about 98.5%, and most particularly at least about 98.6%. Aluminum foils of the aluminum-iron-silicon or aluminum-iron-silicon-manganese types may also be used. Other suitable metal foils known in the art may be used as well.

The laminate may also include one or more adhesive layers between a foil layer and the plastic layer. The same or different adhesives may be used to adhere the plastic to the metal foil on each side. The adhesive layer should be capable of forming a bond with the plastic layer and the foil layer, and generally should be of a thickness of between about 0.1 μm and about 12 μm, more typically between about 2 μm and about 8 μm, and any ranges therein. Any number of adhesives known in the art may be used, and the adhesives may be applied using a number of known techniques. Suitable adhesives may contain one or more solvents, be solvent-free, or may be acrylic adhesives or polyurethane adhesives. The adhesive may also be a thermal bonding adhesive, for example an ethylene-vinylacetate copolymer or a polyester resin. The adhesive may also be of a type which hardens upon exposure to electromagnetic rays, for example ultraviolet rays. The laminate may also be formed by hot calendaring, extrusion coating, co-extrusion coating or through a combination of processes. Example adhesives that may be used in the present disclosure include but are not limited to polyethylene (PE) homopolymers, such as LDPE, MDPE, LLDPE, and HDPE; PE copolymers, such as ethylene-acrylic acid copolymers (EAA), ethylene methacrylic acid copolymer (EMAA); polypropylene (PP); PP copolymers; ionomers; and maleic anhydride grafted polymers.

In another embodiment, the film, e.g., a metal-plastic laminate, may feature a sealing layer in the form of a sealable film or a sealable coating on one of the outer lying sides, or on both of the outer sides. The sealing layer will be the outermost layer in the laminate. In particular, the sealing layer may be on one outer side of the film, which is directed towards the contents of the shaped packaging, in order to enable the lid foil or the like to be sealed into place.

One or more of the outerlying areas may also provide a surface with a high coefficient of friction. In one embodiment the high coefficient of friction may be achieved through the selection of material of the outer lying side, such as a polyurethane coating. A second embodiment is by the addition of a light adhesive to a section of the outer lying surface, such as an adhesive designed to provide adhesion with low release force as in the case of post-it notes or painter's masking tape. Another embodiment for forming blister packaging is a laminate of aluminum, where the metal foil is coated with a plastic on each side. Aluminum foil is known to provide superior barrier properties to protect the contents of the package. The plastic coating provides an effective means of sealing the package plus provides a protective coating for the aluminum, and may also provide the ability to print on the package.

In some embodiments, the thicknesses and compositions of the laminate include but are not limited to:

i. OPA/ALU/PE (12 μm/60 μm/30 g/m$^2$);
ii. OPA/ALU/PE (12 μm/45 μm/30 g/m$^2$);
iii. OPA/ALU/PVC (12 μm/60 μm/30 g/m$^2$);
iv. OPA/ALU/PVC (12 μm/45 μm/30 g/m$^2$);
v. OPA/ALU/PP (12 μm/60 μm/30 g/m$^2$); and
vi. OPA/ALU/PP (12 μm/45 μm/30 g/m$^2$). As used above, OPA stands for oriented polyamide, ALU stands for aluminum, PE stands for polyethylene, PVC stands for polyvinylchloride, and PP stands for polypropylene.

Prior to the present disclosure, those of skill in the art used the ratio of the diameter of the depression in the original surface of the film to the depth of the formed depression in the film to describe the degree of deformation of a film after forming. While this ratio is simple and easy to calculate, it does not describe the amount of stretch of the material, which is a more accurate reflection of the deformation of the film. Therefore, the diameter to depth ratio is limited in its ability to reflect the success of a particular process to reliably and repeatedly stretch a film such as a foil laminate. A better description of the degree of deformation is the "Area Ratio." The Area Ratio is the ratio of the area of the stretched or final recess formed in the film ($Area_F$) to the area of the original surface of the film ($Area_I$). The Area Ratio takes into account the stretch of the material and shape of the formed recess, not just its depth. The techniques of forming described in this application are known to successfully produce a formed recess, such as a blister, with an Area Ratio of about 1.0, about 1.1, about 1.2, about 1.3, about 1.4, about 1.5, about 1.6, about 1.7, about 1.8, about 1.9, about 2.0, about 2.1, about 2.2, about 2.3, about 2.4, about 2.5, about 2.6, about 2.7, about 2.8, about 2.9, or about 3.0, to 1. As used herein, an Area Ratio of, for example, about "3.0" is equivalent to an Area Ratio of about "3.0/1."

Prior to the present disclosure, shaped articles made of laminates containing metal foils in the art were generally shaped into the desired structure using a cold-forming process. As used herein, the term "cold forming" refers to pressure forming under ambient conditions, e.g., without the application of exogenous heat. Cold-forming utilizes a temperature that is no higher than about 40° C., and more typically is no higher than about 35° C. As disclosed herein, a warm-forming process includes a warm forming step for manufacturing shaped articles using a film such as a metal foil containing laminate. The warm-forming process may comprise only warm-forming steps, or may comprise both warm-forming and cold-forming steps. When forming materials consisting of plastic film laminated to one or both sides of a metal foil, it is beneficial to warm the material during the forming step. Warming the laminate may help prevent delamination, allow the plastic to form with less tendency to warp back to the original shape, and result in a more uniform stretch of the material. To stretch and form the plastic without extruding it, the temperature of the material should be kept below the melting temperature of the plastic film during the warm-forming step. Warm-forming is therefore defined herein as forming a film such as a metal-plastic laminate in the temperature range of 45° C. to 95° C.; for example between 55° C. and 70° C., and any ranges therein. In other embodiments, the warm-forming step is performed at a temperature at or above 45° C., 46° C., 47° C., 48° C., 49° C., 50° C., 51° C., 52° C., 53° C., 54° C., 55° C., 56° C., 57° C., 58° C., 59° C., 60° C., 61° C., 62° C., 63° C., 64° C., 65° C., 66° C., 67° C., 68° C., 69° C., 70° C., 71° C., 72° C., 73° C., 74° C., 75° C., 76° C., 77° C., 78° C., 79° C., 80° C., 81° C., 82° C., 83° C., 84° C., 85° C., 86° C., 87° C., 88° C., 89° C., 90° C., 91° C., 92° C., 93° C., 94° C., or 95° C. In some embodiments disclosed herein, the process uses only warm-forming steps, cold-forming steps, or a combination of warm-forming and cold-forming steps.

The film layer is deformed into the desired shape of the formed recess using two or more Forming Pins. The Forming Pins employed in the present disclosure may be of any shape, including but not limited to cylindrical, conical, cone, blunted cone, pyramid, blunted pyramid, segment of a sphere or cap, or barrel shaped, or a hemispherical shape with a planar top. When describing the blisters, "top" and "bottom" are relative terms. During the forming process, the greatest depth below the surface of the mold can be considered the bottom of the recess and form the bottom of the blister. However, in referring to a hemispherical shape, the bottom of the blister is considered the top of the hemisphere. The Forming Pins may comprise particular vertical or steep side walls, vertical or sloping side walls, and the edges or periphery at the bottom of the Forming Pins may have a small radius, or may be round or roundish in shape. It is preferred that the geometry of the shape-forming surface of the Forming Pins vary to progressively form the desired recess, for example by using Forming Pins with gradually different surface geometries. The recesses formed in the film according to the processes disclosed herein may be of any desired shape or depth, including but not limited circular, ovoid, square, triangular, rectangular, polygonal, and elliptical shapes, as well as complicated blister shapes such as deep blisters, blisters with steep angled or vertical walls, and deep blisters with a small inner radius and vertical walls. The base portion of the formed recess may be planar or hyperbolic, and may have a uniform width or a tapered width.

One unique aspect of the present disclosure involves the application of the first Forming Pin to the film. While processes known in the art typically drive the first Forming Pin into the film from 50% to less than 100% of the final desired depth, the processes disclosed herein drive the first Forming Pin into the film to at least about 100% or greater of the final desired depth. For example, when two Forming Pins are used, the first Forming Pin is driven into the die opening, which causes the film to be formed into a primary contour, which has a depth of at least about 100% and up to about 150% of the depth of the formed recess, and any ranges therein. In other embodiments, the first Forming Pin is driven into the film to a depth of about 105%, about 110%, about 115%, about 120%, about 125%, about 130%, about 135%, about 140%, or about 145%. The first Forming Pin may also be driven to a diameter to depth ratio of less than about 2.5, about 2.4, about 2.3, about 2.2, about 2.1, about 2.0, about 1.9, about 1.8, about 1.7, about 1.6, or about 1.5. Thus, unlike other methods known in the art, the first step of the process disclosed herein produces substantially all of the draw of the film required for the final formed recess. Heat may be used to help accomplish this stretch in one or more warm-forming steps. In addition, the Area Ratio of the primary contour is from greater than 1.0/1 to 3.0/1, and any ranges therein, as described herein.

After the formation of the primary contour, a second or subsequent Forming Pin is driven into the primary contour to a depth that is generally less than the depth of the primary contour, such that the second Forming Pin forms a different geometric shape for the formed recess with substantially the same Area Ratio as the primary contour. Thus, the processes disclosed herein are again different from those known in the art, which typically involve driving a second or subsequent Forming Pin to a depth greater than the depth achieved by the previous Forming Pin, thereby producing additional draw of the film beyond that achieved by the first or previous Forming Pin. In other methods known in the art, the second or subsequent Forming Pin may also be driven to a depth beyond the final desired depth of the depression formed to compensate for films that spring back towards the original plane of the film. In contrast, for example, in the processes disclosed herein, the second (or subsequent) Forming Pin is driven to a depth that is less deep than the first or previous Forming Pin. The second (or subsequent Forming Pin) may also be driven to a depth that is less than the final depth (i.e., less than about 100%) of the formed recess desired. In certain embodiments, the second (or subsequent Forming Pin) Forming Pin is driven into the film to a depth that is less than about 99%, about 98%, about 97%, about 96%, about 95%, about 94%, about 93%, about 92%, about 91%, about 90%, about 89%, about 88%, about 87%, about 86%, about 85%, about 84%, about 83%, about 82%, about 81%, or about 80% of the primary contour or of the formed recess. The second or subsequent Forming Pin may reshape, stretch, or redistribute the previously drawn surface of the primary contour to form the geometric detail desired in the final formed recess. Thus, the second (or subsequent) Forming Pin is not designed to substantially draw the film beyond the final shaped depth. Instead, the second (or subsequent) Forming Pin reshapes, stretches, or redistributes the recess, which often results in decreasing the depth of the recess through directing the film into the desired shape. The application of heat in a warm-forming step with the second or subsequent Forming Pin can help form the detail of the final recess.

Applying the second (or subsequent) Forming Pin in a warm forming step can help to reduce elastic spring-back of the film, for example a metal-plastic laminate, and can assist in reducing potential delamination of the plastic layer(s) from the foil. Although the process described herein uses a first and second Forming Pin, it is understood that more than two Forming Pins may be used to achieve the desired shape of formed recess. Additionally, the forming of the desired formed recess may take place in a single line of sequential steps or in several parallel lines of sequential steps. For example, multiple Forming Pins may be used to produce blister packs with a plurality of formed recesses.

The Forming Pins disclosed herein may have the same or different degrees of friction when contacted with the film. For example, the Forming Pins may be coated with a high friction layer or a low friction layer. In certain embodiments, the degree of friction is decreased with each successive Forming Pin, while in other embodiments, the degree of friction is increased with each successive Forming Pin. It is well within the skill of those in the art to vary the degree of friction of each successive Forming Pin as desired, including increasing and/or decreasing the degree of friction as appropriate, even within a single series of Forming Pins. The friction layer of the forming surface may comprise one or more plastics such as polytetrafluoroethylene (PTFE), polyoxymethylene (POM), polyethylene, polyacetal, polyethyleneterephthalate (PET), rubber (e.g., hard rubber), caoutchoucs, acrylic polymers, glass, ceramic, graphite, boron nitride, molybdenum disulphide, or mixtures thereof. Alternatively, the friction layer may comprise one or more metals, for example an aluminum, chromium, or steel layer (particularly polished metal layers), or a ceramic layer containing graphite, boron nitride or molybdenum disulfide. The surfaces of the Forming Pin when metal may also be designed to achieve low friction values, for example by polishing.

In another embodiment, the process disclosure herein may be performed using Forming Pins that are arranged coaxial or telescopically inside each other. For example, a first Forming Pin can form the first contour, and then be raised within the first contour followed by the lowering of a second Forming Pin, which slides telescopically in the first Forming Pin, to effect the final forming of the desired recess in the film.

After the desired recess is formed, it may be sealed by the application of a coating such as a lidding over the opening of the formed recess. Sealing methodologies are well known to those of skill in the art, including but not limited to flat seals, diamond patterns, or otherwise applying heat and/or pressure (e.g., using a press, hot roller, platen press or a heated platen press) to the surfaces of the film and the coating. In certain embodiments, the lid stock material is puncturable at a limited distance, is capable of splitting, minimizes the generation of particulates, creates a barrier, withstands radiation, has desirable chemical properties (e.g., does not react with the contents), and/or can be printed on. For pharmaceuticals, industry guidelines suggest a seal width in the range of 0.1 inch. When packaging pharmaceutical dosage forms, it is important to achieve a good seal such that gases or other environmental elements cannot diffuse into the formed recess and damage the dosage form packaged therein. In certain embodiments, particularly when the unit dose is small, it is desirable to minimize the area of the seal. For applications such as foodstuffs or pet foods, the packaging is larger, designed to hold from 1 gram to 150 grams, from 5 grams to 100 grams, or from 5 grams to 50 grams, for example. As larger sized blisters are made, the seal area is contemplated to increase proportionally.

The sealing of a coating such as a lid stock onto a plane of film with one or more formed recesses may be accomplished in an area (e.g., circular area) around the shaped recess. When narrow seals are required, the flat seal may not provide sufficient seal strength to resist dynamic pressure when the formed recess (e.g., a blister) is crushed. Although such a seal is usually adequate to prevent water vapor or oxygen transmission, it may be more likely to leak when the contents are placed under the pressures caused during the dispensing process. Diamond pattern seals may provide a stronger seal by utilizing concentrated points of pressure to create a more robust seal. But diamond pattern seals, which are usually in a linear array pattern, may not uniformly encircle a round blister and may not be consistent around the circumference of the seal, especially in a narrow-width seal on a small blister. Thus, in certain embodiments, it may be desirable to add contours to the sealing area to reduce the width required by at least half or, conversely, produce a substantially stronger seal when using the suggested width. For example, creating annular seals (corrugated in the cross section) may provide the same benefits as the diamond pattern, but in a manner that is uniform around the circumference of the blister seal.

Exemplary processes for forming the blisters useful in the disclosed devices are described in commonly owned U.S. Pat. No. 7,963,089, which is incorporated herein in its entirety by reference.

The following embodiments are included to illustrate the compositions and methods disclosed herein. It should be appreciated by those of skill in the art, in light of the present disclosure, that many changes can be made in the specific embodiments which are disclosed herein and still obtain a like or similar result without departing from the spirit and scope of the invention.

FIG. 1 is an illustration of a delivery device 10, configured for oral delivery to the sublingual mucosa of a user. The device includes a housing 12, and a flange or finger rest 14 to facilitate manual delivery. A delivery button 16 is partially contained within the housing and extends below the housing, positioned such that a user can grip the flange with two fingers and actuate the delivery button with a thumb. Also included in the oral delivery device is a positioning device 18 that can be rested against the lower teeth of a user to direct a spray from the nozzle port 20.

Figure 2:
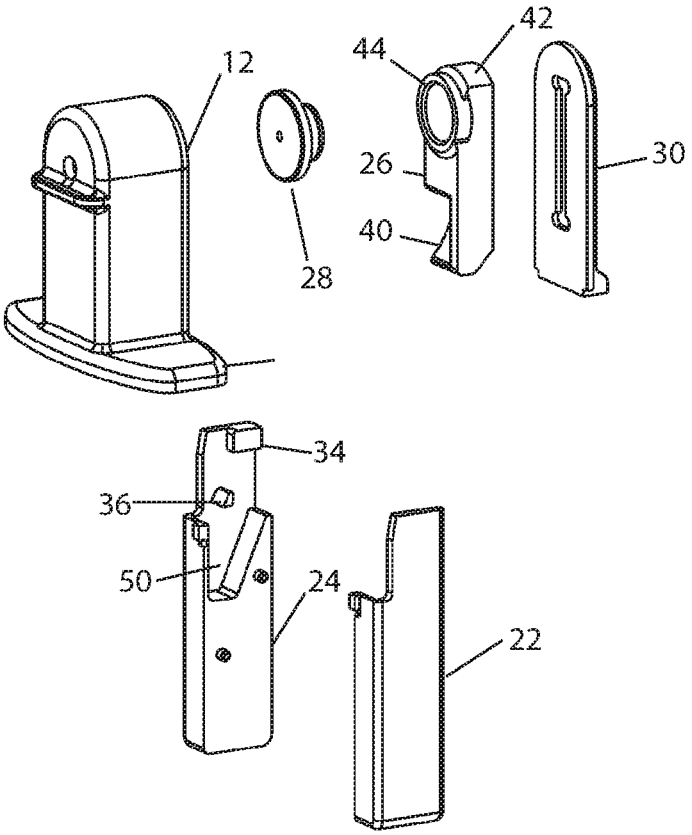
FIG. 2 is an exploded view of the device of FIG. 1.
Figure 3:
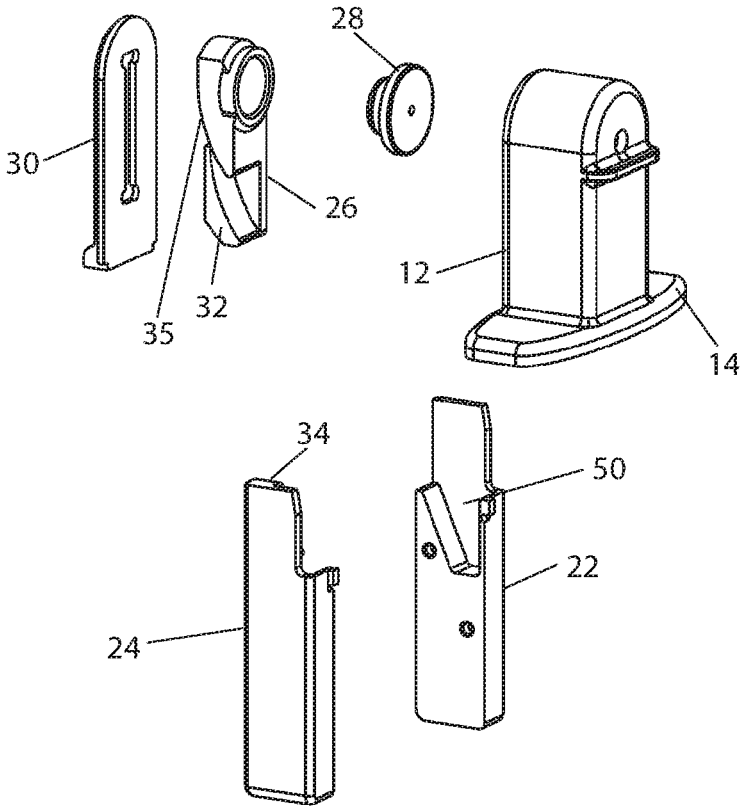
FIG. 3 is an alternate exploded view of the device of FIG. 1.

FIGS. 2 and 3 are exploded views from opposite sides of the delivery device including the housing 12, the first 22 and second 24 sides of the button device 16, the plunger 26, the blister 28, and the back face 30 of the housing. The plunger includes a lower section 40 and upper section 42. When the device is assembled, the lower section of the plunger fits against the recess 50. The plunger includes an inclined or arcuate planes or surfaces 32 and 50 that interact with and are guided by tabs 34 and 36 respectively to transfer the vertical motion of the button in a direction other than the direction of motion of the button when activated, or in certain embodiments in a lateral direction to dispense the fluid in a perpendicular direction relative to the direction of motion of the button. In the illustrated embodiment a lateral direction is shown as substantially 90° from the direction of motion of the button. It is understood, however, that the device can also be configured to orient delivery of the fluid at within 1% to 5%, 10%, 20%, 30% or 45% above or below 90% from the direction of the button.

Figure 4:
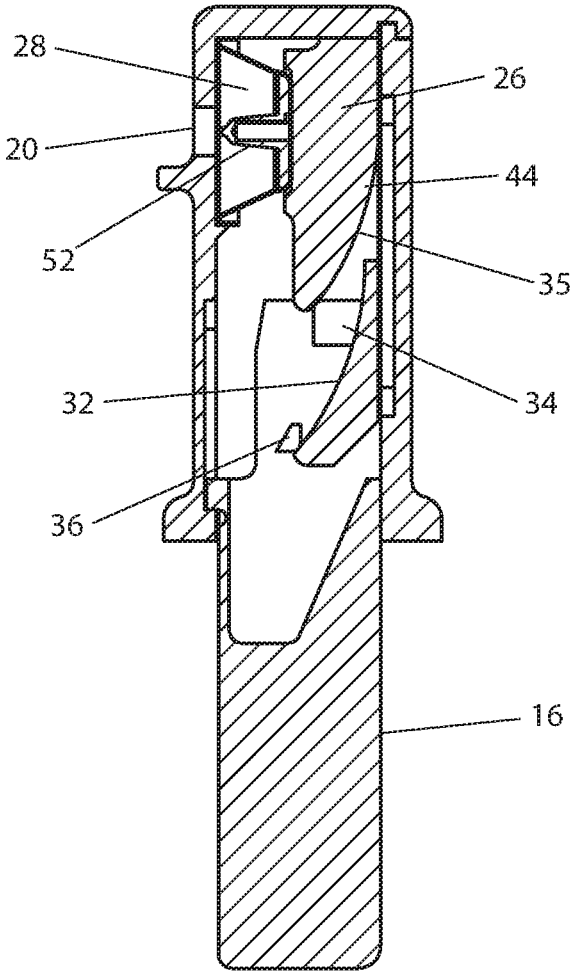
FIG. 4 is a cross section view of the device of FIG. 1 prior to dispensing.
Figure 5:
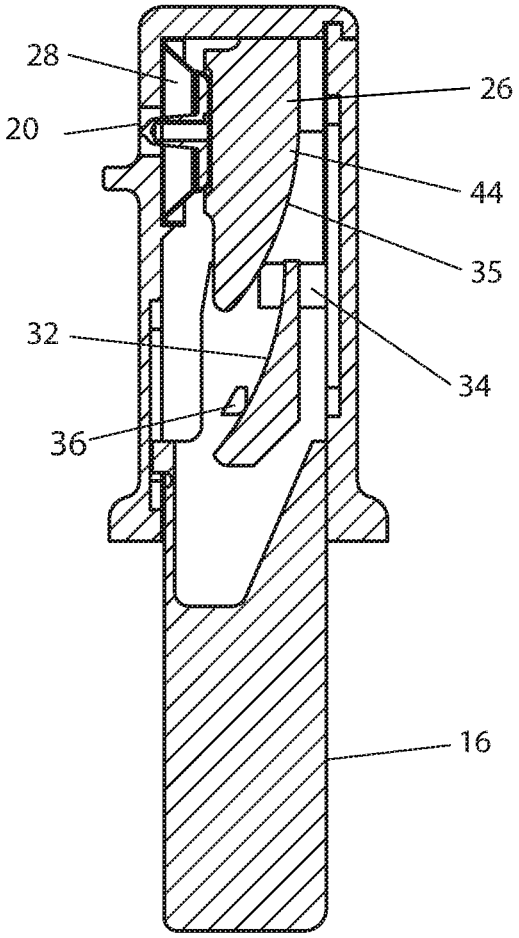
FIG. 5 is a cross section view of the device of FIG. 1 in a partially dispensed configuration.
Figure 6:
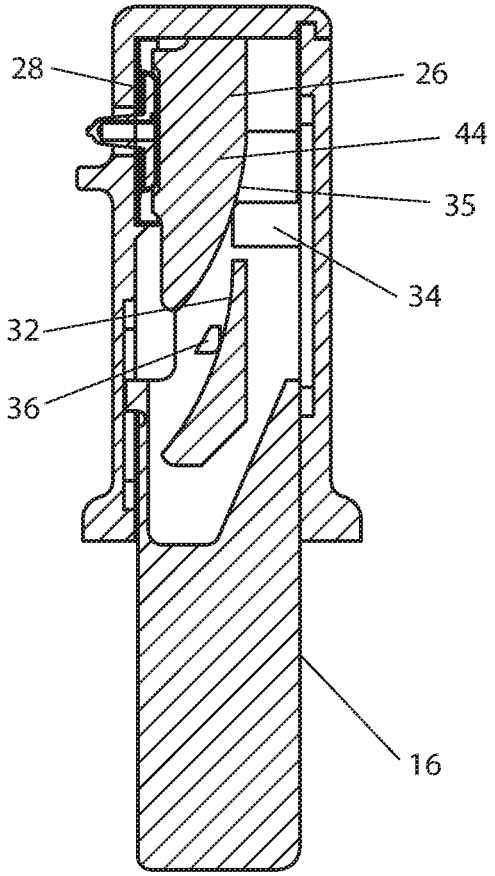
FIG. 6 is a cross section view of the device of FIG. 1 in a fully dispensed configuration.

FIG. 4 is a cross sectional view of the device in the storage or ready configuration. The plunger includes a ram device 44 that rests against the base of the crushable dosage form 28, which contains the piercing device 52. As shown in FIG. 5, a cross sectional view of the device after the dispensing motion has begun, during upward motion of the button, tab 34 impinges on a curved or arcuate surface 35 of the plunger, forcing the face 44 of the plunger against the base of the blister 28. FIG. 6 is a cross sectional view of the fully dispensed device in which the blister has been crushed, forcing the fluid contents of the blister through the piercing device and out the nozzle and through the port.

Figure 7:
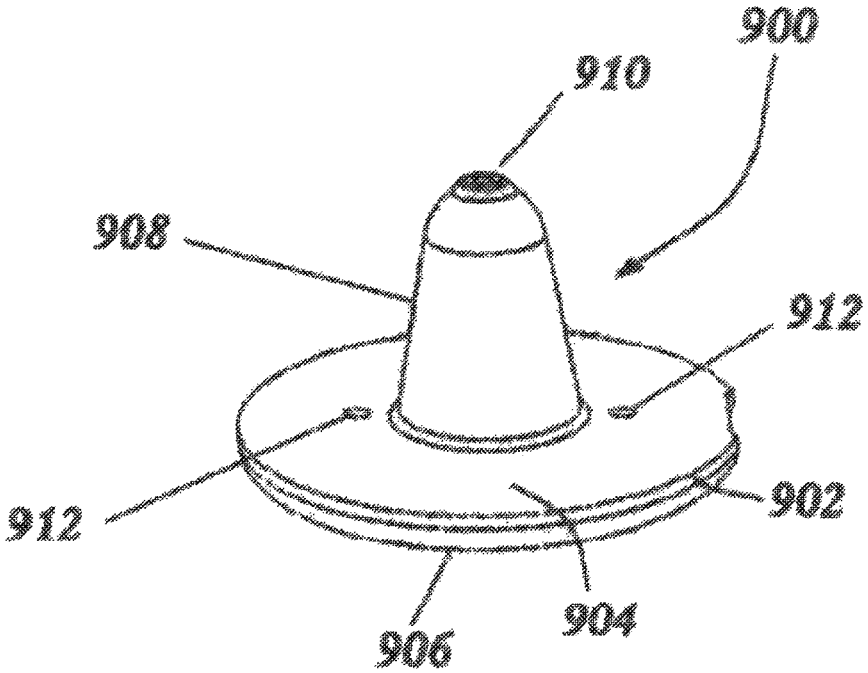
FIG. 7 is an illustration of a piercing device for use in an internally pierced blister.

An embodiment of a piercing nozzle 900 for use in an internally pierced blister is shown in FIG. 7. The nozzle includes a base 902 with an upper surface 904 and a bottom 906. Attached to and extending from the base is an elongated member 908 that terminates in a discharge nozzle 910. Inlet openings 912 are shown in the top surface 904 of the base 902.

Figure 8:
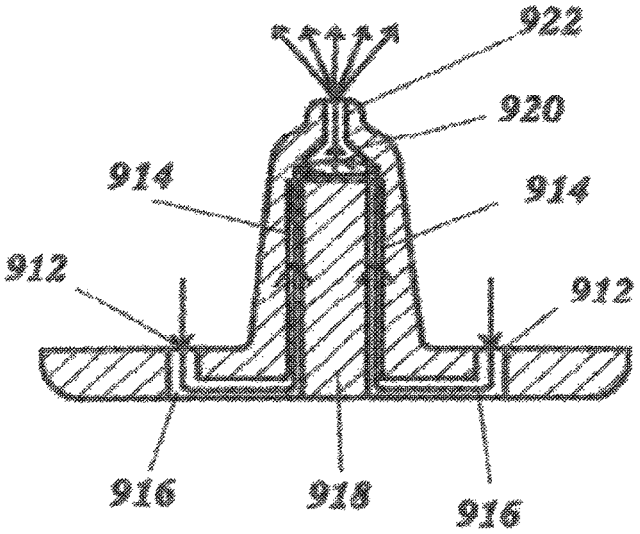
FIG. 8 is an illustration of a piercing device of claim 7, showing the fluid path through the piercing device.

The fluid path through the piercing nozzle is shown in more detail in FIG. 8. This nozzle is designed to be embedded in a formed blister as described herein, with the base of the piercing nozzle held in place at the bottom or formed portion of the blister and the piercing end and discharge nozzle at or near the piercable surface. The blisters are used in devices that hold the blister in place and force a ram or piston against the bottom of the blister, crushing it and forcing the fluid contents through the piercing nozzle and out the discharge port in a precisely dosed, controlled spray or mist. As shown in FIG. 8, as the blister is crushed, fluid in the blister is forced into the inlet openings 912, through the inlet channels 916, up through the internal channels 914, into the swirl chamber 920 and out the discharge nozzle 922. In the cross-section view, the solid central column 918 is shown to block the fluid from the central channel of the elongated member, creating a higher pressure fluid path if needed.

As described herein, the piercing nozzles can also be used with or without a solid central column depending on the intended use. In certain embodiments, a two piece piercer includes the device shown in FIG. 8 and a second cylindrical column is placed in the opening 922 to produce the configuration shown in the device in FIG. 8. Alternate configurations of the piercing device are described in U.S. Pat. No. 8,585,659, and U.S. patent application Ser. No. 14/515,489, each incorporated herein in its entirety by reference.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the methods described herein without departing from the concept, spirit and scope of the invention. More specifically, it will be apparent that certain agents that are chemically or physiologically related may be substituted for the agents described herein while the same or similar results would be achieved. All such similar substitutes and modifications apparent to those skilled in the art are deemed to be within the spirit, scope and concept of the invention as defined by the appended claims.

The invention claimed is:

1. A device for delivery of a fluid composition, said device comprising:

a housing comprising a front face, a first side, a second side and a rear face; and a top, forming an interior volume;

a button comprising a first side, a second side, a first end contained within the housing and a second end extending out of the housing at an end opposite the top;

wherein the button comprises recess adapted to mechanically interact with said button, a first tab, and a second tab;

a delivery mechanism disposed in the interior volume of the housing; and a nozzle port disposed in the front face of the housing and providing a liquid communication channel into the interior volume; wherein the delivery mechanism comprises:

a plunger comprising a lower section adapted to be in mechanical connection to the button, wherein the lower section comprises a first arcuate surface;

an upper section comprising a cavity disposed adjacent the nozzle port and adapted to contain a crushable dosage form; and a ram member adjacent the cavity and comprising a second arcuate face; wherein said first tab and said second tab are adapted to interact with said first arcuate surface and said second arcuate surface to direct the motion of the ram in a direction other than the direction of motion of the button when activated.

2. The device of claim 1, further comprising one or more finger rests disposed on said first and/or second side of the housing.

3. The device of claim 2, wherein said one or more finger rests comprise a flange, one or more arcuate members comprising open or closed loops, one or more indentations, or one or more sets of ridges.

4. The device of claim 1, further comprising a positioning device adapted to rest against the lower teeth of a user to direct a spray from the nozzle port into the oral cavity of the user.

5. The device of claim 1, wherein the direction of motion of the ram is substantially lateral to the direction of motion of the button when activated.

6. The device of claim 1, further comprising a crushable dosage form containing a fluid composition and an internal piercing device, wherein the internal piercing device comprises a nozzle disposed adjacent or within the nozzle port.

7. The device of claim 6, in which the fluid is a liquid, powder or a reconstituted powder.

8. The device of claim 6, wherein the fluid is a medical composition.

9. The device of claim 8, in which the fluid is a cardiovascular drug, steroid, barbiturate, benzodiazepine, analgesic, anesthetic, sedative, anti-inflammatory, non-steroidal anti-inflammatory (NSAID), antigen; vaccine, hormone, endorphin, enkephalin, dynorphin endomorphin, cannabinoid, biosimilar, synthetic or semi-synthetic opioid or alkaloid analgesic or combinations of any thereof.

10. The device of claim 8 in which the fluid comprises fentanyl, ketamine, a ketamine analog, esketamine, buprenorphine, naloxone, acetaminaphine, morphine, ethylmorphine, oxycodone, hydrocodone, meperidine, hydromorphone, alfentanil, remifentanil, sufentanil etorphine, opiod peptide, or a pharmaceutically acceptable, salt, derivative, prodrug, enantiomer, racemate, or isomer of any thereof.

11. The device of claim 8, in which the fluid comprises a calcium channel blocker, a mineral, an NMDA antagonist, dextromethorphan, memantine, a cholecystokinin antagonist, proglumide, or a phosphodiesterase inhibitor.

12. A method of delivering a fluid substance to the sublingual or buccal tissue of a human or non-human animal comprising dispensing a fluid substance from the device of claim 1.

13. A device for delivery of a fluid composition, said device comprising:

a housing comprising a front face, a first side, a second side and a rear face, and a top, forming an interior volume;

a button comprising a first side, a second side, a first end contained within the housing and a second end extending out of the housing at an end opposite the top;

wherein the button comprises recess adapted to mechanically interact with said button, a first tab, and a second tab;

a delivery mechanism disposed in the interior volume of the housing; and a nozzle port disposed in the front face of the housing and providing a liquid communication channel into the interior volume;

wherein the delivery mechanism comprises:

a plunger comprising a lower section adapted to be in mechanical connection to the button, wherein the lower section comprises a first arcuate surface;

an upper section comprising a cavity disposed adjacent the nozzle port and adapted to contain a crushable dosage form; and a ram member adjacent the cavity and comprising a second arcuate face;

wherein said first tab and said second tab are adapted to interact with said first arcuate surface and said second arcuate surface respectively, effective to direct the motion of the ram in a direction other than the direction of motion of the button when activated; and a crushable dosage form contained in the cavity and containing a fluid composition and an internal piercing device, wherein the internal piercing device comprises a nozzle disposed adjacent or within the nozzle port when activated.

14. The device of claim 13, further comprising one or more finger rests disposed on said first and/or second side of the housing.

15. The device of claim 14, wherein said one or more finger rests comprise a flange, one or more arcuate members comprising open or closed loops, one or more indentations, or one or more sets of ridges.

16. The device of claim 13, further comprising a positioning device adapted to rest against the lower teeth of a user to direct a spray from the nozzle port into the oral cavity of the user.

17. The device of claim 13, wherein the direction of motion of the ram is substantially lateral to the direction of motion of the button when activated.

18. The device of claim 13, in which the fluid is a liquid, powder or a reconstituted powder.

19. The device of claim 18, wherein the fluid is a medical composition.

20. The device of claim 18, in which the fluid is a cardiovascular drug, steroid, barbiturate, benzodiazepine, analgesic, anesthetic, sedative, anti-inflammatory, non-steroidal anti-inflammatory (NSAID), antigen, vaccine, hormone, endorphin, enkephalin, dynorphin endomorphin, cannabinoid, biosimilar, synthetic or semi-synthetic opioid or alkaloid analgesic or combinations of any thereof.

21. The device of claim 18 in which the fluid comprises fentanyl, ketamine, a ketamine analog, esketamine, buprenorphine, naloxone, acetaminaphine, morphine, ethylmorphine, oxycodone, hydrocodone, meperidine, hydromorphone, alfentanil, remifentanil, sufentanil etorphine, opiod peptide, or a pharmaceutically acceptable, salt, derivative, prodrug, enantiomer, racemate, or isomer of any thereof.

22. The device of claim 18, in which the fluid comprises a calcium channel blocker, a mineral, an NMDA antagonist, dextromethorphan, memantine, a cholecystokinin antagonist, proglumide, or a phosphodiesterase inhibitor.

23. A method of administering a drug to the oral cavity of a user comprising:

positioning a device according to claim 13 such that the nozzle port is aimed into the oral cavity of the user; and activating the button effected to crush the dosage form and administer the fluid in a spray, stream or mist into the oral cavity of the user;

wherein the device is positioned such that a user activates the button in an upward direction and the fluid is dispensed laterally into the oral cavity.

24. The method of claim 23, wherein the device comprises a positioning device, and wherein the positioning device is rested against the lower teeth of the user during activation of the button.

* * * * *